US008052078B2

(12) United States Patent
DeLuca et al.

(10) Patent No.: US 8,052,078 B2
(45) Date of Patent: Nov. 8, 2011

(54) WIRE DISPENSING DEVICE

(75) Inventors: Edward F. DeLuca, Pittsburgh, PA (US); Gregory J. Buczkowski, Glenshaw, PA (US)

(73) Assignee: Field Pro, Inc., Pittsburgh, PA (US)

( * ) Notice: Subject to any disclaimer, the term of this patent is extended or adjusted under 35 U.S.C. 154(b) by 295 days.

(21) Appl. No.: 11/958,853

(22) Filed: Dec. 18, 2007

(65) Prior Publication Data

US 2008/0156916 A1 Jul. 3, 2008

Related U.S. Application Data

(60) Provisional application No. 60/875,423, filed on Dec. 18, 2006.

(51) Int. Cl.
*B65H 55/00* (2006.01)
*B65H 49/18* (2006.01)

(52) U.S. Cl. ..... 242/170; 242/588.2; 242/588.6; 242/613

(58) Field of Classification Search ..... 242/170, 242/171, 588–588.6, 557, 587, 587.2, 613, 242/406; 206/389, 408, 409; 220/810, 661; 190/115, 102
See application file for complete search history.

(56) References Cited

U.S. PATENT DOCUMENTS

| | | | | | |
|---|---|---|---|---|---|
| 3,612,233 | A * | 10/1971 | Nagpal et al. | ..... | 190/117 |
| 4,301,979 | A * | 11/1981 | Cavanagh | ..... | 242/587 |
| 4,552,323 | A | 11/1985 | Otis | | |
| 4,944,472 | A | 7/1990 | Stahl | | |
| 5,267,705 | A | 12/1993 | Hofrichter et al. | | |
| 5,348,241 | A | 9/1994 | Huette | | |
| 5,692,700 | A * | 12/1997 | Bobeczko | ..... | 242/588.2 |
| 5,881,967 | A | 3/1999 | Dawson et al. | | |
| 6,145,780 | A * | 11/2000 | Fontana | ..... | 242/588.1 |
| 6,145,781 | A * | 11/2000 | Kawabe et al. | ..... | 242/588.6 |
| 6,267,316 | B1 * | 7/2001 | Cross | ..... | 242/422.5 |
| 6,294,759 | B1 * | 9/2001 | Dunn, Jr. | ..... | 219/231 |
| 6,491,163 | B1 * | 12/2002 | Grcic et al. | ..... | 206/403 |
| 6,783,833 | B2 * | 8/2004 | Bordner et al. | ..... | 428/66.6 |
| 6,991,196 | B2 | 1/2006 | Wheeler | | |
| 7,121,501 | B1 | 10/2006 | Lea | | |
| 7,293,734 | B1 * | 11/2007 | Kantner | ..... | 242/395.1 |
| 2001/0030383 | A1 * | 10/2001 | Swanson et al. | ..... | 264/308 |

* cited by examiner

*Primary Examiner* — William E Dondero
(74) *Attorney, Agent, or Firm* — The Webb Law Firm

(57) ABSTRACT

A wire dispensing device for containing a roll of wire having a free end. The device includes a plurality of enclosure walls connected to each other and forming an enclosure, where at least one of the walls is operable between an open position, thereby providing access to an internal area of the enclosure, and a closed position, thereby substantially enclosing the roll of wire positioned therein. At least one dispensing orifice extends through at least one surface of the enclosure and permits passage of the free end of the wire therethrough for use in dispensing the wire from the device. A method of dispensing wire from a roll of wire, and a method of manufacturing a dispensing device are also provided.

17 Claims, 6 Drawing Sheets

WIRE DISPENSING DEVICE

CROSS REFERENCE TO RELATED APPLICATIONS

This application claims the benefit of priority of U.S. Provisional Patent Application No. 60/875,423, filed Dec. 18, 2006, which is incorporated herein by reference in its entirety.

BACKGROUND OF THE INVENTION

1. Field of the Invention

The present invention relates generally to systems and devices for dispensing wire, cord, etc. from a roll for use in a specified application, and in particular, to a wire dispensing device for use in dispensing wire from a roll in a construction setting or similar work area.

2. Description of Related Art

According to the prior art, wire, cord and other similar lengths of material are often provided to consumers and third parties in the form of a roll. For example, outdoor and indoor electrical wiring may be purchased in the form of a roll of wire, i.e., a long, continuous length of wire wrapped around a wooden or plastic spool. However, in many instances, residential, indoor wiring is provided wound, but simply positioned in the packaging. For example, in the field of indoor, structural wiring, builders often use Romex® indoor electrical wire, which is provided in a coiled (and banded) form inside a bag-type package.

Regardless of whether provided on a spool or coiled in a package, there are significant drawbacks and problems that arise while using such wiring. For example, oftentimes during storage and/or transportation, a wire is damaged, as it is unprotected. Presently, in order to protect against such damage, one must rely on self-policing or attempting to store the wire on top of other materials. Therefore, the user must find a safe and protected spot to place the wire, in an attempt to limit snags, abrasions, ultraviolet damage, nicks, cuts, crushes, etc. from other equipment or objects.

Another problem that occurs with such rolls of wiring, whether around a spool or loosely coiled, is the dispensing procedure. Again, as discussed above, simply pulling the wire from the roll often leads to kinks, abrasions, nicks and friction burns. In addition, in the case where the wire is loosely coiled in the package, during the dispensing process the wire often becomes knotted or twisted, which considerably lengthens the installation time. In addition, once unpackaged or exposed, the wire is subject to mishandling, impact, grit, dirt, grime and other factors and situations that lead to damaged wire. In addition, damaged wire is problematic in that, once it is installed in the walls of the home, it is difficult to access for repair purposes.

In an attempt to overcome such drawbacks, various wire dispensing devices are available. For example, Rack-A-Tiers Manufacturing, Inc. offers a Wire Tub, which is simply an open tub with an internal hub around which the wire can be placed. However, in use, the tub remains open and still allows for impact by the various environmental and physical factors discussed above, e.g., objects falling thereon, abrasion, dirt, grit, sawdust, etc. While a top plate is available for use in rewinding the wire placed in the Wire Tub, this plate includes multiple openings and allows the hub to also be exposed. Therefore, the Wire Tub does not provide the full enclosure needed to protect the sensitive wiring placed therein.

Another product available is the Wire Wheel, which is offered by Associated Electronic Products, Inc. The Wire Wheel acts as a rotatable spool placed upon legs, such that the wire is unrolled perpendicular to the ground and in a spaced relationship thereof. While this allows for the wire to be appropriately dispensed, again, and as with the Wire Tub, the wire is exposed to the environmental and physical conditions discussed above.

Other such storage and dispensing devices are the subject of one or more U.S. patents. For example, U.S. Pat. Nos. 4,552,323 to Otis; 4,944,472 to Stahl; 5,267,705 to Hofrichter et al.; 5,348,241 to Huette; 5,881,967 to Dawson et al.; 6,991,196 to Wheeler; and 7,121,501 to Lea all provide various wire spooling and storage systems and devices. However, as discussed above, none of these systems and devices provide maximum (or in some cases even adequate) protection of the wiring during the dispensing process. Further, there is considerable room for improvement in the field of wire storage and dispensing that allows for the safe and efficient dispensing of wire from a protected and secure location.

SUMMARY OF THE INVENTION

It is one object of the present invention to provide a wire dispensing device that overcomes drawbacks and deficiencies of the prior art. It is another object of the present invention to provide a wire dispensing device that protects the wire from various environmental and physical conditions that would otherwise impact or adversely affect the wire, both during storage and dispensing operations. It is a further object of the present invention to provide a wire dispensing device that provides for the safe and efficient dispensing of wires, cords and other lengths of material. It is a still further object of the present invention to provide a wire dispensing device that can be appropriately secured, as well as easily identified for use in construction applications.

Accordingly, the present invention is directed to a wire dispensing device for containing a roll of wire having a free end. The device includes a plurality of enclosure walls connected to each other and forming an enclosure. At least one of the walls is operable between an open position, which provides access to an internal area of the enclosure, and a closed position, which substantially encloses the roll of wire that is positioned therein. Further, the enclosure includes at least one dispensing orifice positioned on the enclosure for permitting the passage of the free end of the wire therethrough. In this manner, the free end of the wire can be pulled and the wire dispensed from the device.

In another aspect of the present invention, provided is a method of dispensing wire (including at least one free end) from a roll of wire. The wire includes a free end. The method includes: providing an enclosure having at least one wall defining a substantially enclosed internal area, where the enclosure includes a dispensing orifice; positioning the roll in the internal area of the enclosure; feeding the free end of the wire through a dispensing orifice; and dispensing the wire from the roll of wire by pulling the free end of the wire through the dispensing orifice In a still further aspect of the present invention, provided is a method of manufacturing a dispensing device. The method includes: providing a plurality of enclosure walls; moveably connecting at least a portion of at least a pair of walls together, thereby forming an enclosure that defines an internal and substantially enclosed area; and forming a dispensing orifice extending through at least one of the plurality of enclosure walls, the orifice connecting the internal and substantially enclosed area with an area outside of the enclosure.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 1(*b*) is the wire dispensing device of FIG. 1 in a closed position;

DESCRIPTION OF THE PREFERRED EMBODIMENTS

Figure 1:
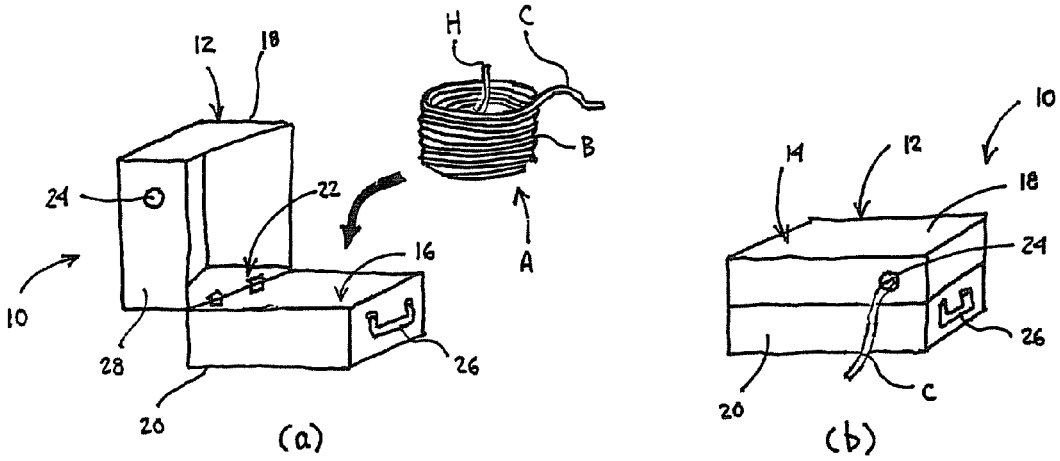
FIG. 1(*a*) is a perspective view of a wire dispensing device in an open position according to the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
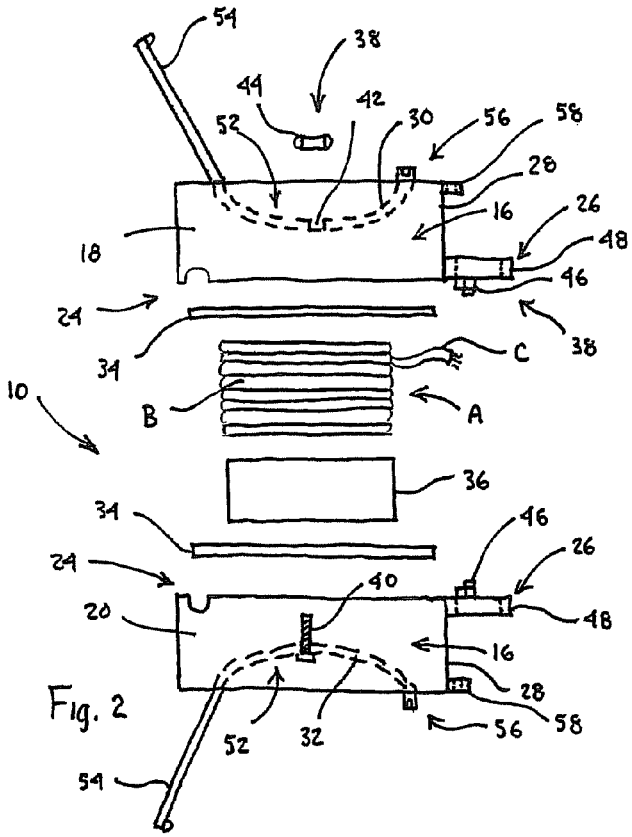
FIG. 2 is an exploded, side view of a further embodiment of a wire dispensing device according to the present invention.
Figure 3:
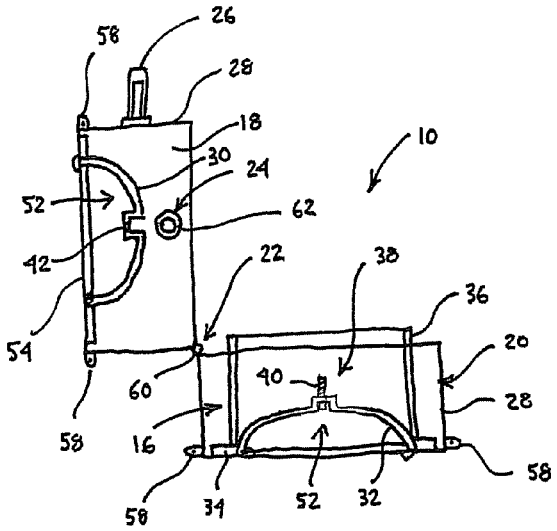
FIG. 3 is a side view of another embodiment of a wire dispensing device according to the present invention.
Figure 4:
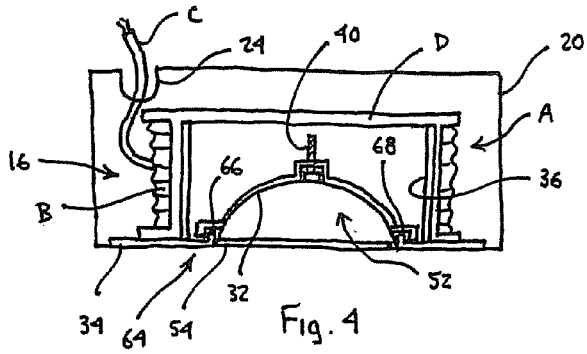
FIG. 4 is a side view of a portion of a still further embodiment of a wire dispensing device according to the present invention.

The present invention is directed to a wire dispensing device 10, as illustrated in various views, embodiments and forms in FIGS. 1-12. The wire dispensing device 10 of the present invention can be used in connection with many types of wires, cords and other lengths of material that are provided in a rolled or coiled form. For example, as seen in FIG. 1, a roll A (or coil) of wire B is provided. This wire B includes a free (dispensing) end C, which allows a user to grasp and uncoil or unroll the wire, as well as another free end H. Of course, the present invention also works effectively with a roll A of wire B that is wrapped around or coiled around a spool D. Such an arrangement is illustrated in FIG. 4. Therefore, the present invention is not limited to any particular type of wire or cord, and is useful in connection with a variety of applications and environments.

As seen in FIG. 1, the wire dispensing device 10 includes multiple enclosure walls 12, and these walls 12 together form an enclosure 14. See FIG. 1(*b*). As seen in FIG. 1(*a*), the roll A of wire B is positioned within an internal area 16 of the enclosure 14.

In one preferred and non-limiting embodiment, the walls 12 are in the form of a first half portion 18 and a second half portion 20. The first half portion 18 and the second half portion 20 are connected together and movable with respect to each other, such as through a hinge arrangement 22. In particular, the hinge arrangement 22 is attached to a portion of each of the first half portion 18 and the second half portion 20, such that the enclosure 14 can be opened and closed. In this manner, the walls 12 are operable between an open position, thereby providing access to the internal area 16 of the enclosure 14 (see FIG. 1(*a*)), and a closed position, thereby substantially enclosing the roll A of wire B, which is positioned in the internal area 16 (see FIG. 1(*b*)). Of course, it is envisioned that access to the internal area 16 may be via a door or other cover member (not shown) formed on or operatively engaged with the enclosure 14.

In order to remove the wire B from the enclosure 14, a dispensing orifice 24 is provided. In particular, the dispensing orifice 24 extends through and is positioned on the enclosure 14 to thereby allow passage of the free end C of the wire B therethrough. As best seen in FIG. 1(*b*), the free end C of the wire B extends through the dispensing orifice 24, and thereby allows a user to grasp the free end C and pull the wire B through the dispensing orifice 24 and out of the enclosure 14.

In another embodiment, and in order to allow the user to manipulate the enclosure 14, a handle 26 may be provided. As seen in FIG. 1, the handle 26 may be a hinged handle attached to an outer surface 28 of the enclosure 14. However, as discussed hereinafter, this handle 26 may take many forms and be used for a variety of purposes. For example, in one embodiment, the handle 26 may be used to secure the enclosure 14 to a particular point, such that the enclosure 14 does not move while the wire B is being dispensed from the device 10. In addition, the handle 26 may be used to secure the enclosure 14 to a position above the ground surface, thereby providing additional protection from the environmental and physical conditions that may impact it, as well as facilitating a more efficient dispensing process. Still further, the handle 26 may be integrally formed with or on the enclosure 14.

A further embodiment of the device 10 is illustrated in FIG. 2. In this embodiment, a first hub 30 and a second hub 32 are provided. In particular, the first hub 30 extends or projects from the first half portion 18 and within the internal area 16 of the enclosure 14, while the second hub 32 extends or projects from the second half portion 20 and into the internal area 16 of the enclosure 14. Further, the first hub 30 and the second hub 32 provide an arrangement that allows the roll A of wire B to be directly or indirectly positioned over and around the hubs 30, 32. In operation, when the wire B is removed from the enclosure 14, the roll A spins and moves around the hubs 30, 32 and out of the dispensing orifice 24, which maintains the integrity of the roll A and prevents the wire from becoming tangled within the enclosure 14.

In order to facilitate the spinning movement of the roll A of wire B in the internal area 16 of the enclosure 14, one or more discs 34 may be provided. The roll A of wire B will be positioned between these discs 34, and facilitate more effective and low-friction spinning of the roll A. In addition, in the instances where the roll A of wire B does not include a spool D, such a spool 36 may be provided. Accordingly, one disc 34 is placed in the second half portion 20 over the second hub 32, and next, the spool 36 is positioned over the second hub 32. The roll A of wire B is then placed over the spool 36, and the other disc 34 is placed on top of the roll A of wire B. In this manner, when the first half portion 18 and second half portion 20 are closed against each other in an abutting relationship (thereby forming the enclosure 14), all of the discs 34, the spool 36 and the roll A of wire B are captured within the enclosure 14, but allowed to spin and dispense the wire B.

In the embodiment of FIG. 2, the dispensing orifice 24 is provided in two parts or halves, each on an edge portion of the half portions 18, 20. Therefore, and unlike the contiguous dispensing orifice 24 extending through a single wall 12 of the enclosure 14 (as illustrated in FIG. 1), in the embodiment of FIG. 2, the dispensing orifice 24 is provided when the first half portion 18 and second half portion 20 are closed. One benefit of this is that the wire B is much more easily captured within the dispensing orifice 24, as well as removable from the enclosure 14. For example, even if the wire B is considerably dispensed from the device 10, the device 10 may be opened and the roll A of wire B easily removed without the requirement of rewinding the wire B.

Remaining with the embodiment of FIG. 2, and in order to better secure the first half portion 18 and second half portion 20 together, one or more attachment arrangements 38 may be provided. Various such attachment arrangements 38 are envisioned within the scope and context of the present invention. One arrangement 38 includes a bolt 40 extending from the second hub 32 in the second half portion 20 of the enclosure 14. The first hub 30 in the first half portion 18 includes a bolt orifice 42, through which the bolt 40 may extend. Specifically, a threaded portion of the bolt 40 extends through this bolt orifice 42. Next, a nut 44 is threaded onto and secured to the bolt 40, thereby removably attaching the first half portion 18 and second half portion 20 via their respective hubs 30, 32. For example, the nut 44 may be a wing nut or other easily manipulatable component. Of course, any removable attachment arrangement 38 is envisioned.

The embodiment of FIG. 2 also provides a second and complimentary attachment arrangement 38. As discussed above, and as illustrated in this embodiment, a handle 26 is provided. However, in this embodiment, the handle 26 includes a first portion 48 and a second portion 50. In addition, each portion 48, 50 of the handle 26 is in operable communication with a swivel clip 46, each of which is configured to swivel over and engage a portion of the first portion 48 of the handle 26 and the second portion 50 of the handle 26. In this manner, the enclosure 14 is further secured in a closed position. In addition, the swivel clips 46 are easily rotated or removed, and thereby allow portions 48, 50 of the handle 26 to be separated to open the enclosure 14. A slide clip or similar known locking device or arrangement may also be used.

Also, as seen in FIG. 2, the formation of the first hub 30 and second hub 32 can provide a respective storage area 52. It is envisioned that various objects, possibly associated with the wire dispensing and installation procedure, may be stored within these storage areas 52. In order to protect and contain the items in this storage area 52, each storage area 52 may include a respective and hinged cover 54. This movable cover 54 will serve to enclose and protect the items in the storage area 52, as well as allow access thereto. In order to secure the covers 54 in a closed position, a cover securing arrangement 56 may be used. For example, such an arrangement 56 may be in the form of a clip, a friction lock, a twist lock, etc. It is envisioned that any similar structural arrangement can be used which provides removable access to the items placed in the storage area 52.

As discussed hereinafter, one or more connection members 58 may be provided and attached to the outer surface 28 of the enclosure 14. These connection members 58 may be used to either attach the device 10 to a secure location (which also may be accomplished using the handle 26), and may also serve to attach multiple devices 10 together. These connection members 58 may take a variety of forms, including eyelets and other similar arrangements which allows the devices 10 to be removably attached to each other. In this manner, multiple devices 10 can be attached to each other and provided in a secure location when dispensing various types of wire B in a single installation procedure. In addition, multiple devices 10 can be locked or otherwise attached together using these connection members 58 for the purposes of storage or racking.

Another embodiment of the wire dispensing device 10 is illustrated in FIG. 3. In this embodiment, as opposed to using separate pieces or components to hingedly attach the first half portion 18 with the second half portion 20, a live hinge 60 is used. In particular, and in this embodiment, the enclosure 14 is fabricated from a plastic or polymer material, and the live hinge 60 is also manufactured from a synthetic material that provides flexibility over a long period of time. The material selected to be used for the live hinge 60 may be optimized for minimizing fatigue to the structure, as well as allowing for virtually unlimited opening and closing of the enclosure 14 without wear on the hinge 60.

Also illustrated in FIG. 3, the dispensing orifice 24 may include a sleeve 62 formed around an edge of the orifice 24. This sleeve 62 may be made from a material that has a low coefficient of friction to thereby allow for the smooth passage of the wire B through the dispensing orifice 24. The use of such a sleeve 62 will minimize the chances of the wire B catching or otherwise being damaged during the dispensing process.

A further embodiment of the wire dispensing device 10 is illustrated in FIG. 4. In this embodiment, the roll A of wire B is already provided around a spool D. Accordingly, in this embodiment, the spool D is positioned over the above-described spool 36, or alternatively the spool D of the roll A of wire B can be used in place of the spool 36.

In addition, in order to allow the discs 34 to maintain their position within the internal area 16 of the enclosure 14, a tongue-in-groove arrangement can be used. In particular, an inner edge 64 of each disc 34 may include a projection 66 that is fitted within a groove 68 on the first hub 30 and/or second hub 32. Specifically, the projection 66 is inserted within the groove 68, but allows the respective disc 34 to rotate around the second hub 32. Any similar arrangement of capturing the discs 34 within the enclosure 14 is envisioned.

Figure 5:
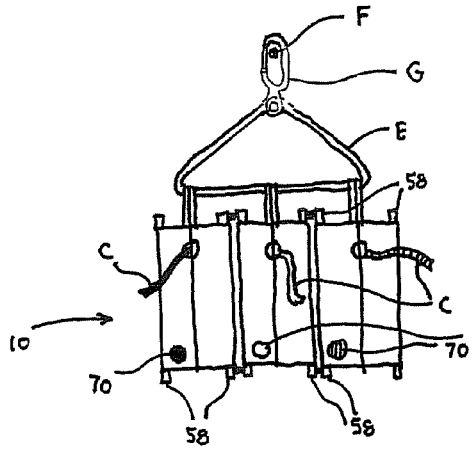
FIG. 5 is a side view of multiple, attached wire dispensing devices according to the present invention.

As discussed above, multiple devices 10 may be attached together for use in the dispensing operation. As seen in FIG. 5, three devices 10 are attached together using respective connection members 58 on the devices 10. In addition, a cord E (or other similar structure) is fed through the handles 26 on each device 10 and attached to an anchor point F. For example, the cord E may be attached to the anchor point F using a clip G, e.g., a karabiner or the like. Therefore, the three devices 10 are not only attached together, but also secured to this anchor point F, which provides efficient and effective dispensing.

In order to allow the users to identify which wire is in which device 10, some type of color coding may be used. For example, the outer surface 28 of the enclosure 14 may be colored to an appropriate color of the wire B, or some similar color coding arrangement. In one embodiment, as seen in FIG. 5, a color identifier 70 may be positioned on the outer surface 28 of the enclosure 14 for use in identifying the roll A of wire B positioned in the internal area 16 of the enclosure 14.

The wire dispensing device 10 of the present invention may be manufactured from a variety of materials. For example, the device 10 may be manufactured in a thermoform process, an injection molding process, etc. Accordingly, the device 10 may be made from a variety of materials, including plastics, polymers, synthetic materials, wood, metal, etc. Of course, it is preferable that the device 10 be manufactured from a lightweight, yet sturdy, material. It is also envisioned that the device 10 (or enclosure 14) be manufactured from a transparent material, which would allow the user to visibly ascertain what type of wire B is positioned therein. Further, as the device 10 is often used in harsh, outdoor conditions, the material construction may be in an ultraviolet-protective material.

Many other features are envisioned for use in connection with the device 10. For example, the device 10 may include rollers or other similar arrangements that allow for the easy mobility of the device 10. Of course, these rollers may be lockable, such as to prevent movement of the device 10 during the dispensing process. In another embodiment, a friction or no-slip material may be applied to various portions of the dispensing device 10, specifically on the outer surface 28 of the enclosure 14, to prevent movement of the device 10 during the dispensing process. It is envisioned that the spool 36 may be either adjustable or provided in multiple sizes to allow for varying amounts of wire B to be placed in the enclosure 14. For example, the spool 36 may be adjustable laterally or longitudinally to provide for the insertion of varying sizes of rolls A of wire B.

A still further embodiment of the present invention is illustrated in various views in FIGS. 6-11. In this embodiment, the device 10 includes the walls 12 forming the enclosure 14, specifically the first half (top) portion 18 (see FIGS. 6-7) and the second half (bottom) portion 20 (see FIGS. 8-9). In this embodiment, the handle 26 is formed by closing and abutting the first half portion 18 and the second half portion 20, and this handle 26 is centrally located on one side of the enclosure 14. Any attachment arrangement 38 may be used to secure the first half portion 18 to the second half portion 20, as discussed above. For example, a sliding lock or other similar removable fastening arrangement can be utilized, and may also be used in connection with the handle 26.

Figure 6:
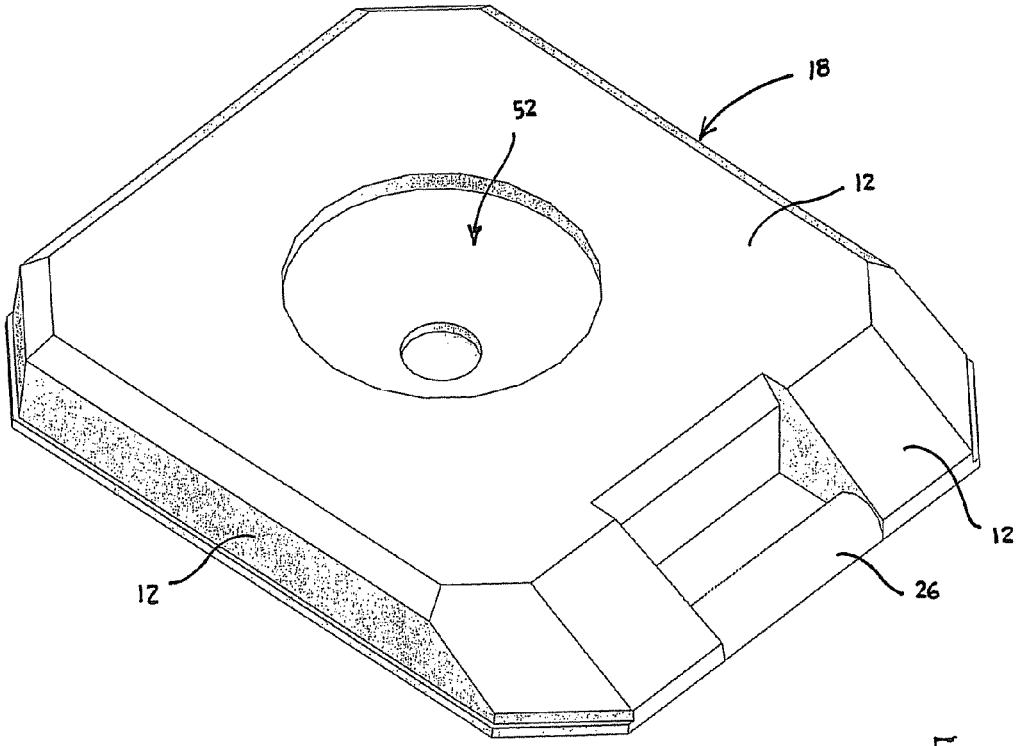
FIG. 6 is a perspective view of a top, outer portion of a further embodiment of a wire dispensing device according to the present invention.
Figure 7:
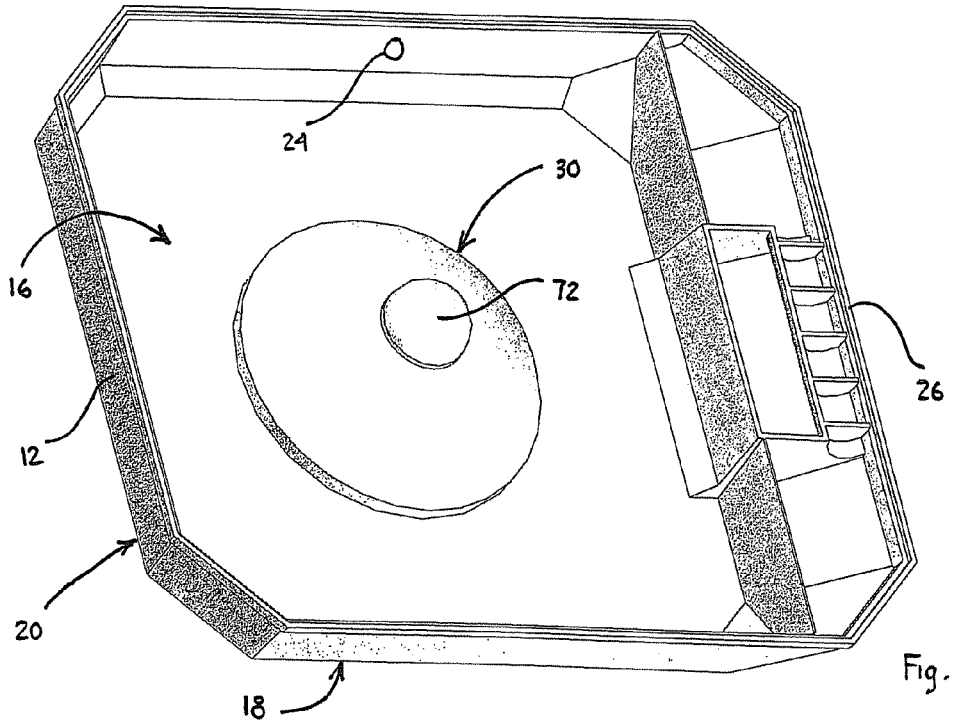
FIG. 7 is a perspective view of a top, inner portion of the embodiment of FIG. 6.

As best illustrated in FIGS. 6 and 7, an in this preferred and non-limiting embodiment, the first hub 30 is in a semi-circular shape (as discussed above in connection with the embodiment of FIG. 2). However, a nipple projection 72 extends from the body of the first hub 30 formed in the first half portion 18. The first hub 30, together with the nipple projection 72, form the storage area 52, which may include a movable cover 54 and be used for storing various items. As discussed, this cover 54 can be held in place or secured using a variety of cover securing arrangements 56 or friction-type locking components. Any manner of allowing the cover 54 to be movably secured over the storage area 52 is envisioned.

Figure 8:
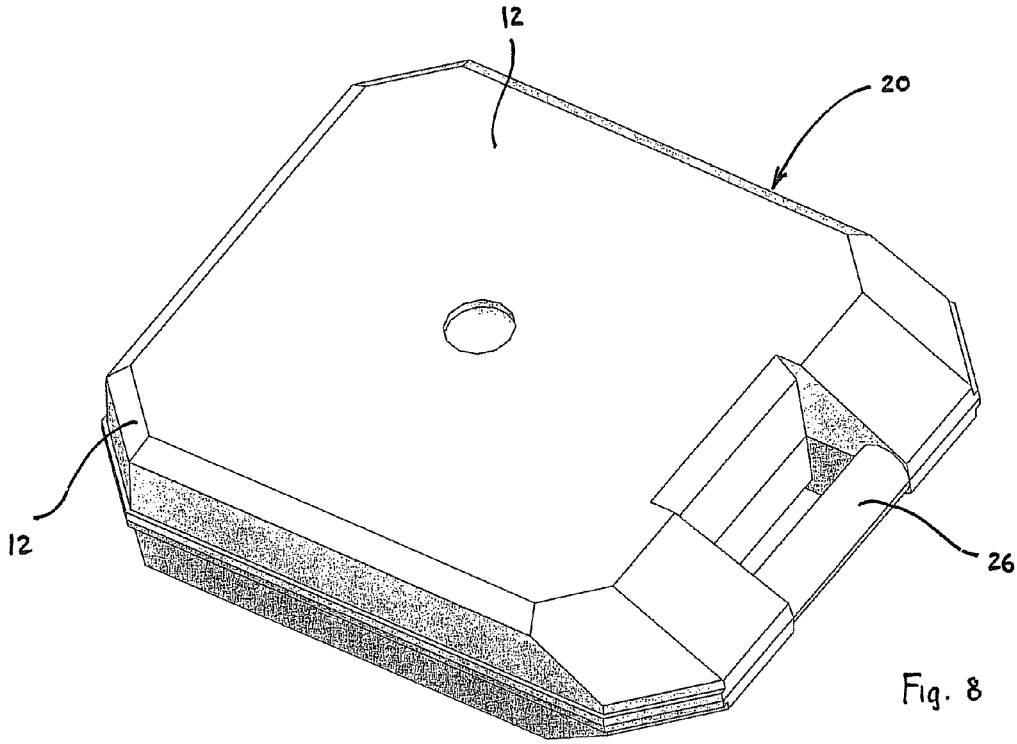
FIG. 8 is a perspective view of a bottom, outer portion of the embodiment of FIG. 6.
Figure 9:
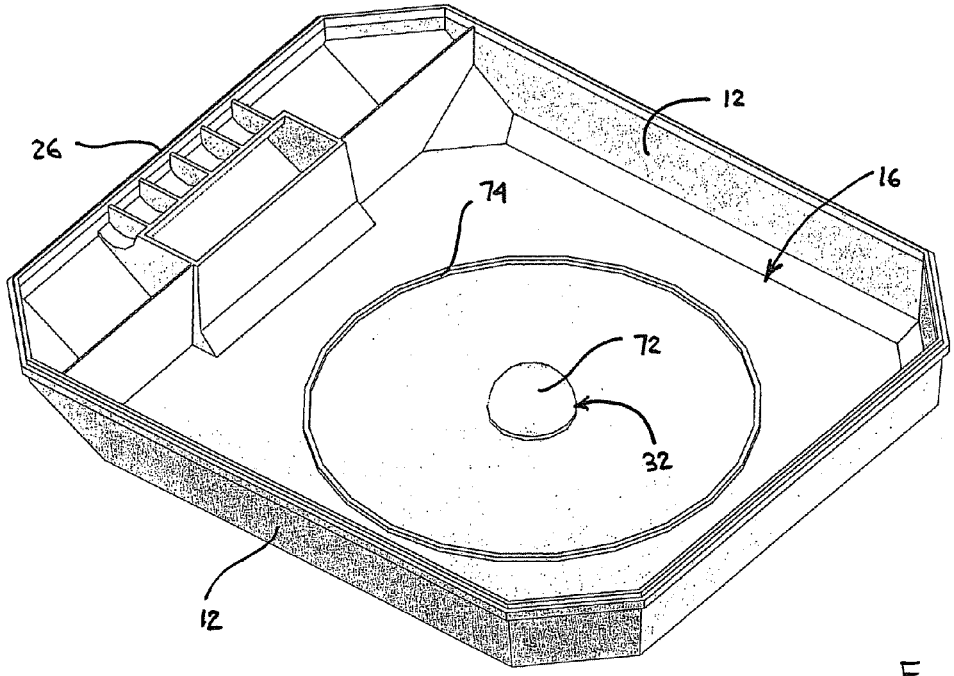
FIG. 9 is a perspective view of a bottom, inner portion of the embodiment of FIG. 6.
Figure 10:
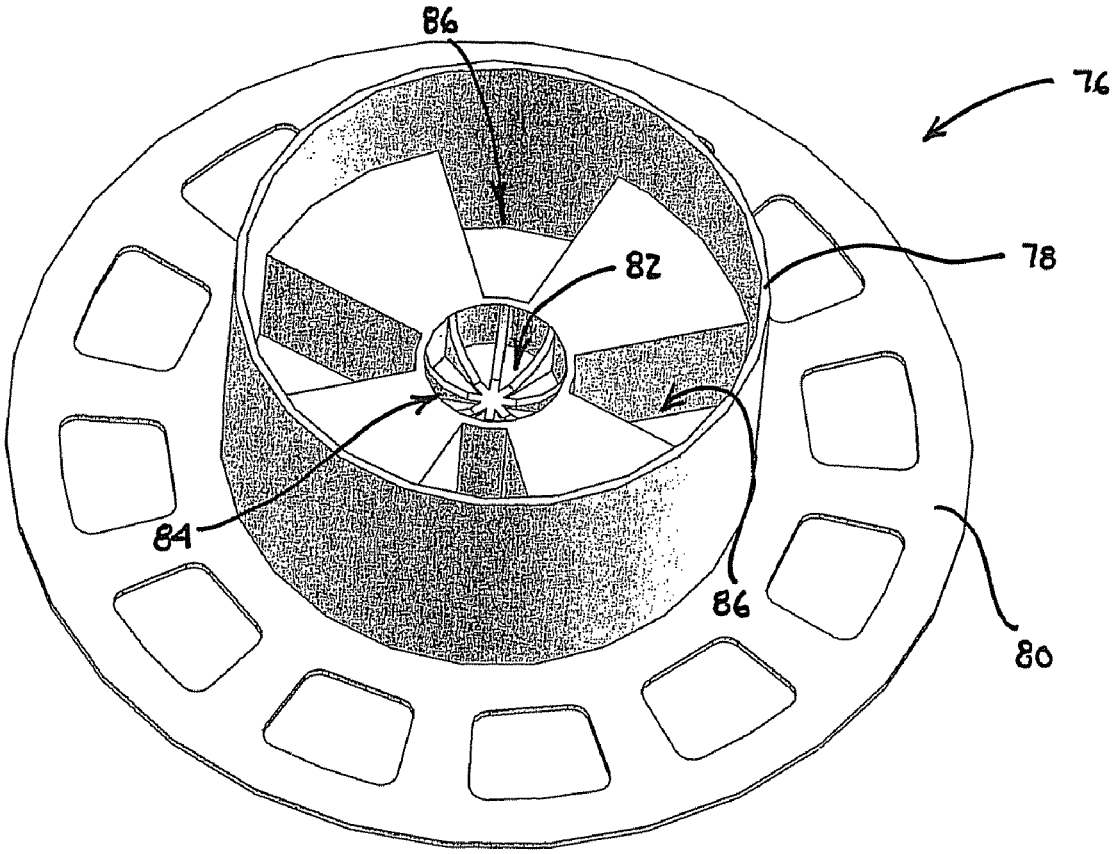
FIG. 10 is a perspective view of a disk/spool member of the embodiment of FIG. 6.
Figure 11:
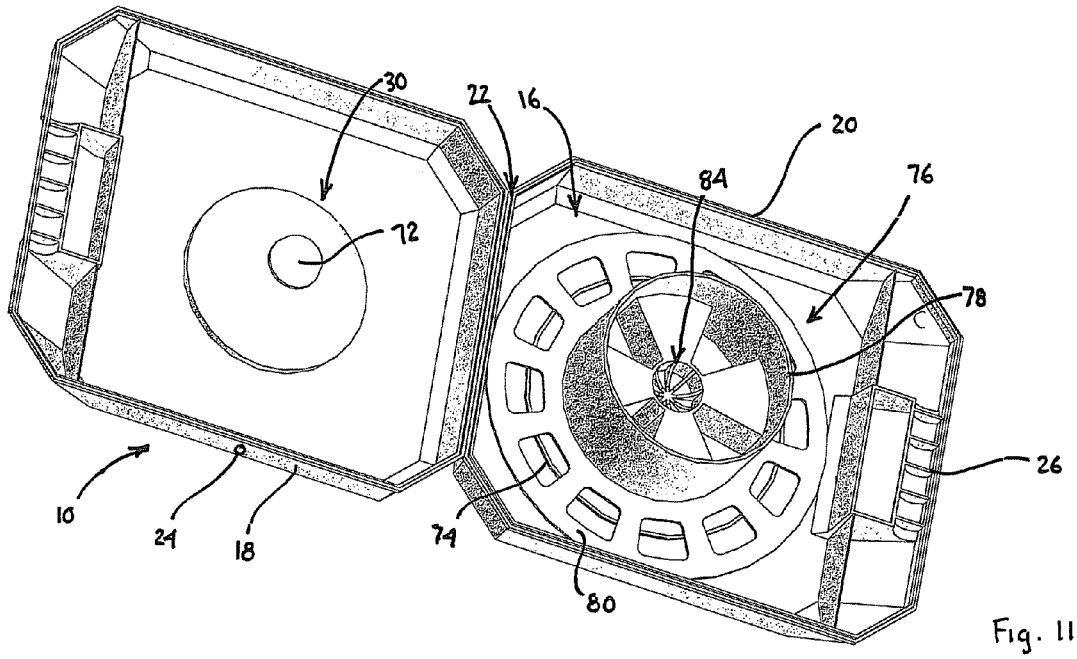
FIG. 11 is a perspective view of an assembled version of the embodiment of FIG. 6.

Turning to FIGS. 8 and 9, where the second half portion 20 of the enclosure 14 is illustrated, and in this embodiment, the second hub 32 is in the form of the nipple projection 72 (as discussed above). In addition, a circular ridge 74 is provided for contacting a disk/spool member 76, as illustrated in FIGS. 10 and 11 and discussed hereinafter. This arrangement and closure allows the first hub 30 and second hub 32 to form a central portion for use in locating and placing the disk/spool member 76, as well as the roll A of wire B or spool C.

The disk/spool member 76 (as seen in FIG. 10) is formed from a spool portion 78 and a disk portion 80. In a preferred embodiment, the disk/spool member 76 is integrally formed as a single, removable piece locatable over the second hub 32. Specifically, the member 76 is placed over the second hub 32 (in the form of the nipple projection 72), such that the hub 32 is positioned in a central shaft 82 extending through the spool portion 78 and disk portion 80. Similarly, the nipple projection 72 extending from first hub 30 is received in a receiving pocket 84 located in the central shaft 82. In operation, when the first half portion 18 and the second half portion 20 are closed together, the nipple projections 72 are appropriately located and center the disk/spool member 76, and provide for the rotation or spinning of the member 76 (via the location of the nipple projection 72 of the first half portion 30 in the receiving pocket 84, and the nipple projection 72 of the second half portion 32 at least partially within the central shaft 82).

In order to provide additional rotatability of the disk/spool member 76, and to minimize friction during the rotation operation, the disk portion 80 is located or position on the circular ridge 74. In this manner, the contact between the spinning member 76 and the inside surface of the enclosure 14 is minimized. As also illustrated in FIG. 10, the spool portion 78 includes multiple, spaced gaps 86. These gaps 86 (or the walls defining the gaps 86) can be used to unwind or rewind the disk/spool member 76 (and, thus, the wire B). In particular, the user simply grasps within the gaps 86 and moves the member 76 in the desired direction. The assembled version of the device 10 of this embodiment is illustrated in FIG. 11, with the disk/spool member 76 placed on the second hub 32 and circular ridge 74. At this point, the user may place the roll A of wire B (or spool D of wire B) over or on the disk/spool member 76. The free end C of the wire is fed through the dispensing orifice 24, and the device 10 is ready for used.

Figure 12:
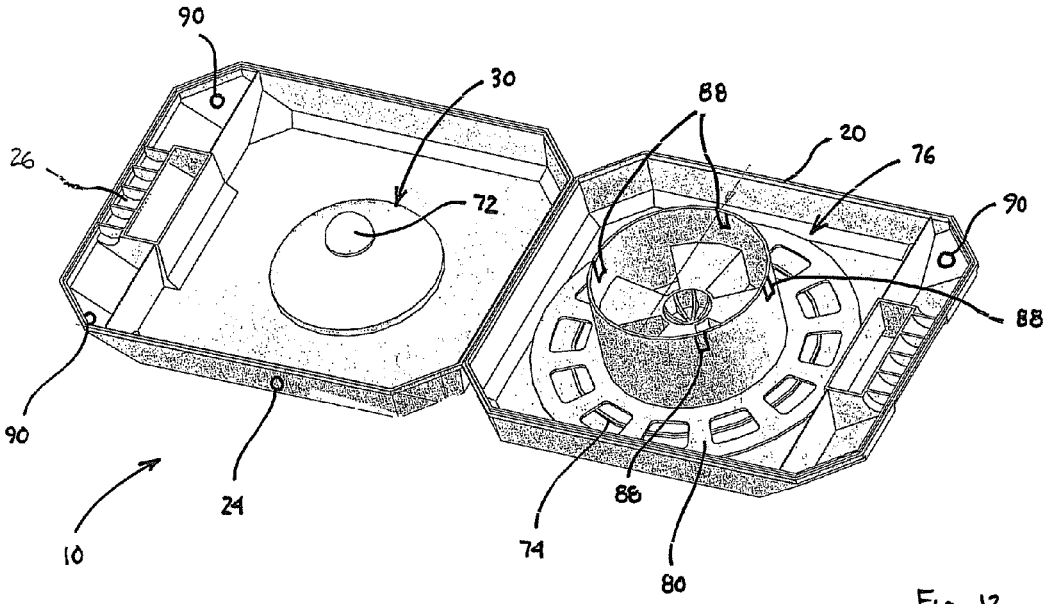
FIG. 12 is a perspective view of an assembled version of a still further embodiment of a wire dispensing device according to the present invention.

A still further embodiment of the device 10 of the present invention is illustrated in FIG. 12. In this non-limiting embodiment, the disk/spool member 76 is provided with a plurality of notches 88 on the spool portion 78. These notches 88 are used to receive the second (or inner) free end H of the wire B. In operation, and when the free end H is attached to at least one of these notches, the wire B is prevented from being disconnected from the member 76, and likewise, ensures that the wire B and member 76 spin or rotate in unison. In this embodiment, multiple notches 88 are provided for use in the easy placement, positioning and attachment of the free end H, without the need to stretch or bend the wire B.

As also illustrated in FIG. 12, and in this embodiment, the device 10 can be secured or hung from the anchor point F (or secured together to another device 10) using connection orifices 90 extending through at least one wall 12 of the enclosure. Specifically, rope, wire, cord or other similar component can be inserted through one or more of the connection orifices 90 and attached to the anchor point F (or another device 10) in a variety of manners. For example, the rope, wire, cord, etc. can be attached to the clip G (as illustrated in FIG. 5.) Therefore, these orifices 90 provide an alternate attaching arrangement than the arrangement illustrated in FIG. 5, which uses the handles 26 and connection members 58 for attachment purposes. These orifices 90 may be positioned at desired positions on the enclosure 14, but are sized, shaped and positioned in a manner that would not allow environmental or physical impact to the wire B in the enclosure 14.

In this manner, the present invention provides a wire dispensing device 10 that allows for the efficient and effective dispensing of wire B from the enclosure 14. Further, the device 10 provides a substantially enclosed area in which the roll A of wire B can be positioned, and which protects the wire B from environmental and other physical factors and impacts. Overall, the presently-invented wire dispensing device 10 allows for the effective and easy insertion and removal of the roll A of wire B, as well as the dispensing thereof.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A wire dispensing device for containing a roll of wire having a free end, the device comprising:

a plurality of enclosure walls connected to each other and forming an enclosure having a first half portion moveably connected to a second half portion through a connection arrangement, the first and second half portions operable between an open position, thereby providing access to an internal area of the enclosure, and a closed and substantially abutting position, thereby substantially enclosing the roll of wire positioned therein;

a first hemispherical hub having a nipple projection arranged on and projecting from an inner surface of the first half portion, and a second hemispherical hub arranged on and projecting from an inner surface of the second half portion, such that in the closed and substantially abutting position, a central portion is formed for locating, centering, and/or permitting at least one of the roll of wire and the spool associated with the roll of wire to spin with reduced friction and the wire to be dispensed therefrom; and at least one dispensing orifice extending through at least one surface of the enclosure and configured to permit passage of the free end of the wire therethrough for use in dispensing the wire from the device.

2. The device of claim 1, wherein the connection arrangement is at least one of the following: a hinge arrangement, a mechanical hinge arrangement, a live hinge arrangement.

3. The device of claim 1, wherein the dispensing orifice comprises a first dispensing orifice portion extending through the first half portion of the enclosure, and a second dispensing orifice portion extending through the second half portion of the enclosure, wherein the first and second dispensing orifice portions are aligned and positioned such that, when the first and second half portions of the enclosure are closed, the first and second dispensing orifice portions form the dispensing orifice.

4. The device of claim 1, wherein the first and second half portions of the enclosure are securable together via an attachment arrangement comprising at least one of the following: a nut/bolt arrangement, a tongue-in-groove arrangement, a swivel clip arrangement, a sliding clip arrangement, a mechanical attaching arrangement, a locking arrangement.

5. The device of claim 1, further comprising at least one connection orifice extending through at least one wall of the enclosure and configured to permit insertion of at least one of the following: a wire, a rope, a cord.

6. The device of claim 1, further comprising at least one recessed portion associated with at least one of the enclosure walls, the at least one recessed portion defining an inner area useable as a storage area.

7. The device of claim 6, further comprising at least one cover moveably connected to at least one of the plurality of enclosure walls and configured to cover and substantially enclose the recessed portion of the device.

8. The device of claim 1, further comprising at least one connection member attached to at least one of the plurality of enclosure walls and configured for use in attaching the device to at least one of the following: a secure location, a surface, another device.

9. The device of claim 1, further comprising a handle associated with at least one enclosure wall of the enclosure and configured to permit a user to grasp the handle and manipulate the device.

10. The device of claim 1, further comprising at least one sleeve formed or positioned around an edge of the dispensing orifice.

11. The device of claim 1, wherein the enclosure walls form a cover member moveably connected to a body portion through a connection arrangement, the cover member operable between an open position, thereby providing access to an internal area of the enclosure, and a closed and substantially abutting position, thereby substantially enclosing the roll of wire.

12. The device of claim 1, further comprising an identifier portion positioned on at least one outer surface of at least one of the plurality of enclosure walls and configured to identify the roll of wire positioned in the internal area of the enclosure.

13. The device of claim 12, wherein the identifier portion is at least one of the following: modifiable, moveable, adjustable, color coded, alphanumeric text, graphics, at least one picture.

14. The device of claim 1, further comprising a member associated with the roll of wire having a spool portion for at least partially receiving, in a receiving pocket, the nipple projection of the first hub, wherein the second hub is in the form of a nipple and configured to contact a portion of the member having a spool portion.

15. The device of claim 1, further comprising a member associated with the roll of wire having a disk portion configured to at least partially contact, during operation, a circular ridge arranged on and projecting from an inner surface of at least one of the first and second half portions, said circular ridge providing an additional bearing surface for the disk portion and further reducing the friction associated with the spinning roll of wire.

16. A wire dispensing device for containing a roll of wire having a free end, the device comprising:

a plurality of enclosure walls connected to each other and forming an enclosure having a first half portion moveably connected to a second half portion through a connection arrangement, the first and second half portions operable between an open position, thereby providing access to an internal area of the enclosure, and a closed and substantially abutting position, thereby substantially enclosing the roll of wire positioned therein;

a first hemispherical hub having a nipple projection arranged on and projecting from an inner surface of the first half portion, and a second hemispherical hub arranged on and extending from an inner surface of the second half portion, such that in the closed and substantially abutting position, a central portion is formed;

a disk/spool member having a spool portion for at least partially receiving, in a receiving pocket, the nipple projection of the first hub, wherein the second hub is in the form of a nipple and configured to contact a portion of the member, the disk/spool member further including a disk portion configured to at least partially contact, during operation, a circular ridge arranged on and extending from an inner surface of the second half portion; and at least one dispensing orifice extending through at least one surface of the enclosure and configured to permit passage of the free end of the wire therethrough for use in dispensing the wire from the device.

17. A method of dispensing wire from a roll of wire, wherein the wire includes a free end, the method comprising:

providing a plurality of enclosure walls connected to each other and forming an enclosure having a first half portion moveably connected to a second half portion through a connection arrangement, the first and second half portions operable between an open position, thereby providing access to an internal area of the enclosure, and a closed and substantially abutting position, thereby substantially enclosing the roll of wire positioned therein;

a first hemispherical hub having a nipple projection arranged on and projecting from an inner surface of the first half portion, and a second hemispherical hub arranged on and projecting from an inner surface of the second half portion, such that in the closed and substantially abutting position, a central portion is formed for locating and centering a disk/spool member associated with the roll of wire with respect to the enclosure, thereby permitting the spinning of the disk/spool member with reduced friction;

the disk/spool member having a spool portion for at least partially receiving, in a receiving pocket, the nipple projection of the first hub, wherein the second hub is in the form of a nipple and configured to contact a portion of the member, the disk/spool member further including a disk portion configured to at least partially contact, during operation, a circular ridge arranged on and projecting from an inner surface of the second half portion, said circular ridge providing an additional bearing surface for the disk portion and further reducing the friction associated with the spinning roll of wire; and at least one dispensing orifice extending through at least one surface of the enclosure and configured to permit passage of the free end of the wire therethrough for use in dispensing the wire from the device.

* * * * *